US008672233B2

(12) United States Patent
Sinclair

(10) Patent No.: US 8,672,233 B2
(45) Date of Patent: Mar. 18, 2014

(54) WATER SAVING APPARATUS

(76) Inventor: Derick Sinclair, Wallasey (GB)

( * ) Notice: Subject to any disclaimer, the term of this patent is extended or adjusted under 35 U.S.C. 154(b) by 295 days.

(21) Appl. No.: 12/682,388

(22) PCT Filed: Sep. 4, 2008

(86) PCT No.: PCT/GB2008/002989
§ 371 (c)(1),
(2), (4) Date: Apr. 9, 2010

(87) PCT Pub. No.: WO2009/034299
PCT Pub. Date: Mar. 19, 2009

(65) Prior Publication Data

US 2011/0000972 A1 Jan. 6, 2011

(30) Foreign Application Priority Data

Sep. 12, 2007 (GB) ..... 0717731.4
Oct. 11, 2007 (GB) ..... 0719840.1

(51) Int. Cl.
*G05D 23/02* (2006.01)

(52) U.S. Cl.
USPC ..... 236/93 A; 236/93 R; 236/99 J; 236/99 K; 236/99 R; 236/100; 4/415; 4/665; 137/337; 137/468

(58) Field of Classification Search
USPC ..... 4/415, 665; 137/337, 468; 236/93 A, 236/93 R, 99 J, 99 K, 99 R, 100
See application file for complete search history.

(56) References Cited

U.S. PATENT DOCUMENTS

| | | | | |
|---|---|---|---|---|
| 4,450,829 | A | 5/1984 | Morita | |
| 4,554,688 | A | 11/1985 | Puccerella | |
| 5,564,462 | A | 10/1996 | Storch | |
| 6,032,687 | A | 3/2000 | Linn | |
| 2008/0061155 | A1 * | 3/2008 | Seymour | 236/12.11 |

FOREIGN PATENT DOCUMENTS

| | | |
|---|---|---|
| GB | 2435490 | 8/2007 |
| WO | 2004/088051 | 10/2004 |
| WO | 20061005138 | 1/2006 |

* cited by examiner

*Primary Examiner* — Cheryl J Tyler
*Assistant Examiner* — Jonathan Bradford
(74) *Attorney, Agent, or Firm* — McKee, Voorhees & Sease, P.L.C.

(57) ABSTRACT

A water saving device includes a housing having a hot water inlet chamber connectable to a hot water supply, a temperature sensing chamber having a cold water outlet connectable to a water storage system, and a hot water outlet chamber having a hot water outlet. The inlet and outlet chambers are interconnected by a first port. The inlet and temperature sensing chambers are interconnected by a second port. The temperature sensing and hot water outlet chambers are interconnected by a third port. The device includes a water-pressure actuated piston that is displaceable upon a drop in water pressure in the hot water outlet chamber. The temperature sensing chamber has a temperature-sensitive valve assembly that closes the third port when the temperature of water is below a predetermined level and opens the third port and closes the cold water outlet when the temperature of water is above a predetermined temperature.

13 Claims, 7 Drawing Sheets

WATER SAVING APPARATUS

CROSS REFERENCE TO RELATED APPLICATIONS

This application is a U.S. national stage application of co-pending commonly owned PCT application number PCT/GB2008/002989, filed on Sep. 4, 2007, entitled "WATER SAVING APPARATUS,"which claims priority to UK patent application numbers 0717731.4 and 0719840.1.

FIELD OF THE INVENTION

The present invention relates to water-saving devices and more specifically to a device for diverting and re-circulating water that would otherwise be wasted.

BACKGROUND OF THE INVENTION

The conservation of clean water is of increasing concern. This concern is most clearly felt in areas of the World such as Africa, the Middle East and Australia, where the environment can be harsh. However, even in countries with a plentiful supply of water, domestic water must be stored in reservoirs and it must be treated to be fit for human consumption.

In areas where water is in plentiful supply, the levels of wasted water are high. On an individual level waste may not be huge, but the accumulated wasted water from all the users represents a large amount of clean water that is simply fed down the drain.

One particular source of waste occurs every morning when it takes time for the hot water to come through the water pipes to the hot tap. As a result the first user at each tap usually turns on the tap until the water runs hot. In this way, in any one city on any one morning, millions of liters of clean water can be wasted.

Various solutions to the above problem have be put forward. However, all of the offered solutions have disadvantages, which, have prevented their wide-scale adoption.

Canadian Patent No 2252350 describes a water supply system wherein water that is either too hot or too cold is prevented from exiting the system via an open tap. The system prevents the wastage of water discussed above by diverting water of the wrong temperature back around the system until the water reaching the chosen tap is the correct temperature.

One of the main problems with the above system is that it requires a complete re-plumbing of the water supply system, including the pipes and taps. This may not be a huge issue with new build properties, but it can be prohibitive in older properties, where the total water savings by the individual property do not warrant the plumbing costs. Furthermore, the nature of the valve system used in Canadian Patent No 2252350 is such that new bathroom furniture (e.g. taps, shower-heads, etc.) must be fitted also. This further increases the costs involved as well as limiting the level of aesthetic choice available to the owners of the property.

Another solution is offered by the "demand system", this system uses the same principal as is used for central heating, it has the hot water being constantly pumped around the water pipes, so when a faucet is opened the passing hot water is there ready for use, this system requires quite an alteration to the plumbing, also needs a supply of electricity for the pump and switches and a water pump that is expensive to buy and run, it also needs the returned and cooled water to be constantly re-heated which is a very uneconomical operation, and is therefore both expensive to install and run, and uses large amounts of valuable energy to constantly re-heat the circulating water. The actual system is extremely expensive and the cost is not recoverable from saved water bills, so is in very little use, and rarely seen on the market. U.S. Pat. No. 4,554,688 is an example of this form of water supply system.

U.S. Pat. No. 5,165,456 describes a more basic solution to the above-mentioned problem with the previously wasted water being diverted to a portable water tank. Whilst such invention provides a solution to the above problem without the disadvantages of the Canadian patent, the invention is impractical and intrusive. The constant need for the user to lift and move the water storage tank would inevitably lead to the system being abandoned.

International PCT Application No. AU2004/000415 discloses a water recovery system that addresses the above identified problem by providing a valve assembly that can be fitted into the plumbing upstream of a tap outlet. The valve assembly ensures that only water that is above a predetermined temperature reaches the tap for discharge. The water that is not above the predetermined temperature is diverted to a water storage means, such as a water tank. The valve assembly is activated by a drop in water pressure at the tap outlet, which occurs when the tap is turned on. This avoids the need for any sort of mechanical connection between the valve assembly and the tap outlet, as was described in UK Application No. 0520317.9.

Although PCT/AU2004/000415 provides an effective solution to the above identified problems the disclosed valve assembly requires expensive and sometimes unreliable components. The use of large ceramic components for example, which require a high level of precision, means that the cost of manufacturing the valve assembly can prohibitive. Also the use of the sometimes unreliable diaphragm in the valve assembly can lead to additional repair costs for the user.

In view of the above solutions to the identified water wastage problem, and the disadvantages thereof, there is a need for water saving system that has minimised hurdles to adoption, so that the average consumer will not be discouraged from adopting a water saving system.

SUMMARY OF THE INVENTION

The present invention provides a water saving device for a hot water discharging means, said device comprising: a housing having a hot water inlet chamber having a hot water inlet connectable to a hot water supply, a temperature sensing chamber having a cold water outlet connectable to a water storage system, and a hot water outlet chamber having a hot water outlet connectable to said hot water discharging means; said hot water inlet chamber and said hot water outlet chamber being interconnected by a first port, said hot water inlet chamber and said temperature sensing chamber being interconnected by a second port, and said temperature sensing chamber and said hot water outlet chamber being interconnected by a third port; a water-pressure actuated piston being slideably mounted within the hot water inlet chamber to define two separate sub-chambers, the first sub-chamber being in fluid communication with the hot water inlet and the second sub-chamber being in fluid communication with the hot water outlet chamber via said first port, said piston being displaceable upon a predetermined drop in water pressure in the hot water outlet chamber, caused when the hot water discharging means is opened, from a first position, in which the second port is closed by the piston, to a second position, in which the second port is open; and said temperature sensing chamber having a temperature-sensitive valve assembly, that closes the third port when the temperature of water flowing through the housing is below a predetermined level, and being arranged to open the third port and close the cold water outlet, when the temperature of water flowing through the chamber is above a predetermined temperature.

Preferably the piston comprises an outlet which, when the piston is in the second position, aligns with the second port to enable the hot water inlet chamber to communicate with the temperature sensing chamber.

Preferably the piston is biased towards the first position by a resilient biasing means.

Preferably the first and second sub-chambers of the hot water inlet chamber are defined by the piston, which fits within the hot water inlet chamber. Further preferably the second port comprises a first ceramic washer and the outlet comprises a second ceramic washer, said washers being arranged to facilitate a water-tight seal when the piston is in the first position, whilst allowing fluid communication between the hot water inlet chamber and the temperature sensing chamber when the piston is in the second position.

Preferably the first and second sub-chambers of the hot water inlet chamber are defined by the interaction of the piston and a water tight seal located between the piston and the walls of the hot water inlet chamber, said seal being arranged such that the second sub-chamber is in fluid communication with the second port. Further preferably piston outlet is located within the first sub-chamber when the piston is in the first position and in the second sub-chamber when the piston is in the second position.

Advantageously the piston further comprises a plug member that blocks the first port when the piston is in the second position.

The first port may also comprises a one-way valve that only allows water to flow from the second sub-chamber of the hot water inlet chamber to the hot water outlet chamber.

BRIEF DESCRIPTION OF THE PREFERRED EMBODIMENTS

In the drawings, which illustrate exemplary embodiments of the invention:

DETAILED DESCRIPTION OF THE DRAWINGS

Figure 1:
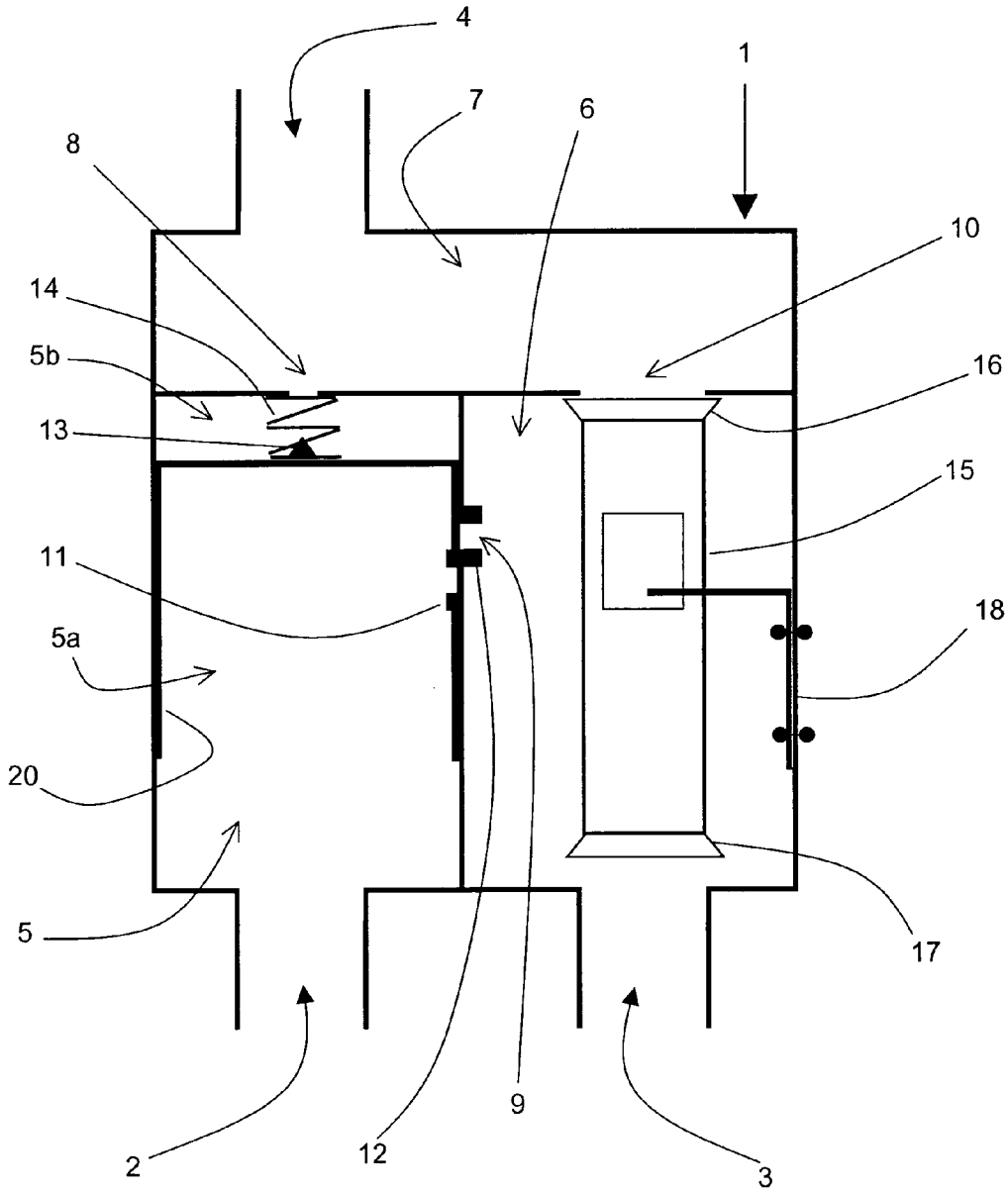
FIG. 1 shows a first embodiment of the present invention wherein the water saving device is connected to a closed water discharging means.
Figure 2:
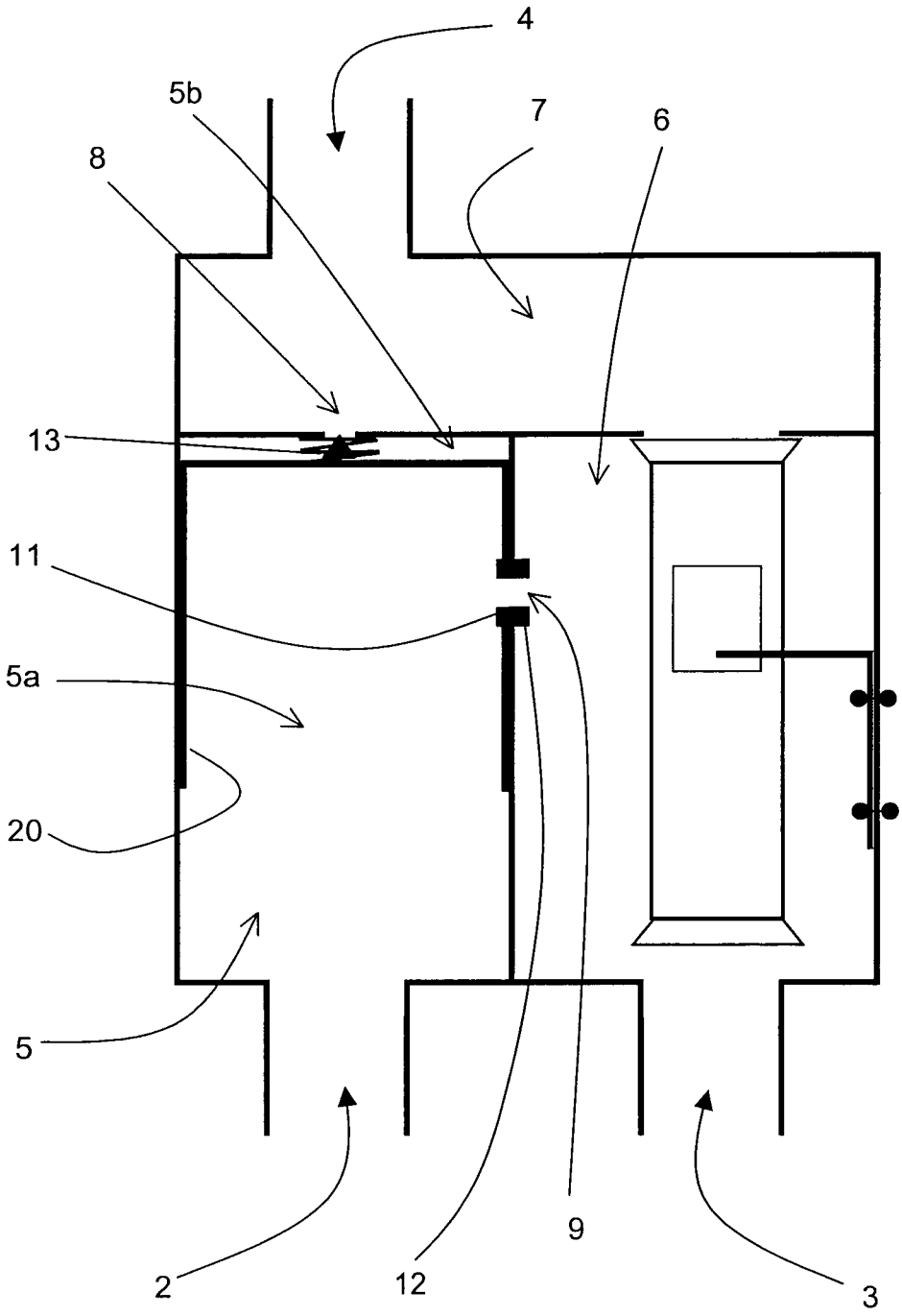
FIG. 2 shows a first embodiment of the present invention wherein the water saving device is connected to an open water discharging means but the water entering the device is below a predetermined level.
Figure 3:
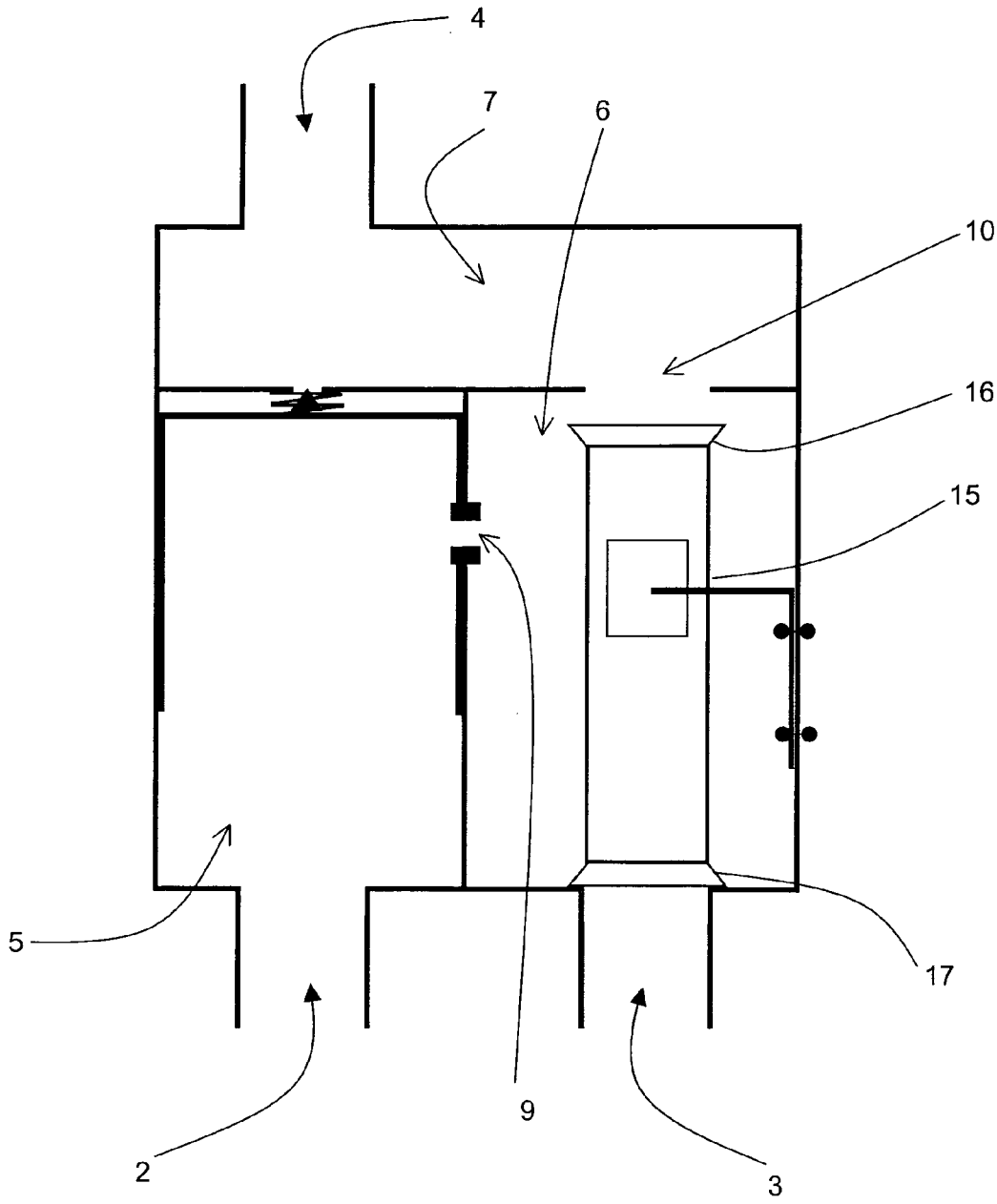
FIG. 3 shows a first embodiment of the present invention wherein the water saving device is connected to an open water discharging means and the water entering the device is above a predetermined level.

A first embodiment of the water saving device of the present invention is shown in FIGS. 1 to 3, with each figure showing the device at a different stage of its cycle of use.

The water saving device 1 comprises a housing with three internal chambers 5, 6 and 7. The first chamber 5 is connectable, via the hot water inlet 2, to the hot water supply of a water supply system and will be referred to hereinafter as the hot water inlet chamber 5. The second chamber 6 is connectable, via the cold water outlet 3, to a water storage system and will be referred to hereinafter as the temperature sensing chamber 6. The third chamber 7 is connectable, via the hot water outlet 4, to a hot water discharging means, such as a tap or shower unit and will be referred to hereinafter as the hot water outlet chamber 7. Of course it is appreciated that other hot water discharging means can be connected to the chamber. It is also appreciated that the means by which the water saving device of the present invention is connectable within a water supply system could be by way of any suitable plumbing connection.

The water saving device also comprises ports to link the internal chambers thereof. The first port 8 links the hot water inlet chamber 5 and the hot water outlet chamber 7. The second port 9 links the hot water inlet chamber 5 and the temperature sensing chamber 6. The third port 10 links the temperature sensing chamber 6 and the hot water outlet chamber 7.

The hot water inlet chamber 5 further comprises a piston 20, which fits flush within the chamber 5. The piston 20, which is slideable within the chamber 5, helps define two sub-chambers within the chamber 5. The first sub-chamber 5*a* is in fluid communication with the hot water inlet 2. The second sub-chamber 5*b* is in fluid communication with the hot water outlet 4 via the first port 8.

The piston 20 has an outlet 11 through which water can flow, said passage being a ceramic washer. Second port 9 is fitted with a ceramic washer 12 that ensures a water-tight seal with the ceramic washer of the piston outlet 11 when said washers 11, 12 are not in alignment. The piston 20 is mounted within the hot water inlet chamber 5 so that the piston 20 can slide from a first position, where the washers 11, 12 are not in alignment and the second port 9 is closed off, to a second position, where the washers 11, 12 are in alignment and the second port 9 is open. The dimensions of the inlet chamber 5 and the piston 20 being such that a substantially water-tight seal is formed, thus preventing water leakage between the first and second sub-chambers 5*a*, 5*b*.

In this embodiment resilient biasing means 14 ensure that when the water pressure with the device is approximately equalised the piston 20 is forced to the first position, thus keeping the washers 11, 12 out of alignment and the second port 9 closed. However it is appreciated that alternative biasing means may be used to ensure that the piston 20 defaults to the first position when the water pressures are approximately equalised. For example, the manner in which the piston is mounted within the chamber 5 could enable the biasing force to be provided by the weight of the piston itself.

A bung means. 13 is also provided on the piston 20. The bung means 13 being aligned with the first port 8 so as to block said port when the piston 20 is in the second position.

The temperature sensing chamber 6 further comprises a temperature actuated valve assembly 15, which is mounted to the housing of the water saving device by a support structure 18. Suitable mounting means will be appreciated by the skilled man, although such means should obviously be made from non-corrosive materials.

The temperature actuated valve assembly 15, which will be described in more detail below, comprises a first valve means 17, which opens and closes the cold water outlet 3, and a second valve means 16, which opens and closes the third port 10. In the default position the first and second valve means 17 and 16 are positioned by the temperature actuated valve assembly 15 so that cold water outlet 3 is open and the third port 10 is closed. When the assembly 15 is subjected to temperatures above a predetermined level the valve means 16 and 17 are actuated to close the cold water outlet 3 and open the third port 10.

The temperature sensitive element of the valve assembly 15 is preferably provided by a wax driven piston. Said piston being arranged to actuate the movement of the valve means when the internal thermal wax expands in response to a rise in temperature.

The water saving device of the present invention is designed to ensure that large amounts of cooled hot water, which was retained in the pipes after the hot water discharging means was last used, are not allowed to flow down the drain while the user waits for freshly heated water to travel from the boiler or hot water tank to the hot water discharging means. The water saving device of the present invention is there for set up to ensure that water that is not above a predetermined temperature does not exit the water supply system via the hot water discharging means, but is instead directed to a water re-circulating system. It will be appreciated that a suitable predetermined temperature may be between 20° C. and 50° C. This general problem and examples of possible water re-circulating systems are discussed in the above mentioned prior art, for example UK Patent Application No. 0520317.9.

The cycle of use of the water saving device will now be described with reference to FIGS. 1, 2 and 3. FIG. 1 shows the water saving device when the hot water discharging means, e.g. a tap, is closed and the device is in its default state. When the associated hot water discharging means is closed no water may leave the hot water outlet chamber 7 via the hot water outlet 4, thus providing a water pressure within said chamber 7. The water pressure of the hot water outlet chamber 7 is shared with the second sub-chamber 5*b* of the hot water inlet chamber 5, because of the fluid communication provided by the first port 8.

The water pressure imparted upon the second sub-chamber 5*b* of the hot water inlet chamber 5 opposes the water pressure created in the first sub-chamber 5*a* of the hot water inlet chamber 5 by the water entering the water saving device via the hot water inlet 2, thus ensuring that the piston 20 is held in a fixed position by the two opposing water pressure forces. In this embodiment the resilient biasing means 14 ensures that the piston 20 is maintained in the first position, wherein the second port 9 is closed by the misaligned ceramic washers 11 and 12. Therefore no water can pass from the hot water inlet 2 to either of the water outlets 3 and 4 when the water saving device is in this state.

When the hot water discharging means is opened the hot water in outlet chamber 7 can leave the device via the hot water outlet 4. This leads to a drop in the water pressure in the hot water outlet chamber 7, which is communicated to the second sub-chamber 5*b* of the hot water inlet chamber 5 via the first port 8. It is appreciated that this arrangement does involve the loss of some water down the drain. However, it is believed that such wasted water serves the purpose of giving the user "feed-back" upon their activation of the hot water discharging means, which is considered to be advantageous.

Following the drop of water pressure in the second sub-chamber 5*b* the consistent force of the water pressure in the first sub-chamber 5*a* of the hot water inlet chamber 5 causes the movement of the piston 20 within the chamber 5, which leads to the state shown in FIG. 2.

The movement of the piston 20 to the second position brings the ceramic washers 11 and 12 into alignment thus opening the second port 9 and allowing water to pass from the hot inlet chamber 5 to the temperature sensing chamber 6. The movement of the piston 20 also causes the first port 8 to be closed by the bung means 13, thus obstructing the flow of water back into the second sub-chamber 5*b* of the hot water inlet chamber 5.

At this stage of the cycle the water entering the water saving device is still below the predetermined temperature set as desirable for water exiting the hot water discharging means. In the default setting, i.e. when the temperature of water within the temperature sensing chamber is below the predetermined level, the valve means 16 and 17 are positioned to close the third port 10 and open the cold water outlet 3. Until the water entering the water saving device, and more specifically the temperature sensing chamber 6, reaches the predetermined temperature it will continue to flow out of the device via the cold water outlet 3 to the water storage/re-circulating system.

Once the temperature of the water entering the temperature sensing chamber 6 of the device reaches the predetermined level the temperature actuated valve assembly 15 caused the valve means 16 and 17 to change position thus opening the third port 10 and closing the cold water outlet 3. This arrangement is shown in FIG. 3.

When the device of the present invention is in the state shown in FIG. 3 the water can flow through the three chambers 5, 6 and 7 and out of the hot water outlet 4 until such time as the hot water discharging means is closed or the temperature of the water falls.

Once the hot water requirement is satisfied and the hot water discharging means is closed again the system begins reverting back to the state shown in FIG. 1. Upon closure of the water discharging means the water pressure in the hot water outlet chamber 7 immediately begins to build up. As the water pressure in chamber 7 builds up it forces the bung means 13 out of the first port 8 thus re-opening the fluid communication between the second sub-chamber 5*b* of the hot inlet chamber 5 and the hot outlet chamber 7. The equalisation of the water pressures in the device chambers, together with the additional biasing force of the resilient biasing means 14 causes the piston 20 to revert back to its first position. The movement of the piston 20 back to the first position closes the second port 9 and thus prevents any further flow of water between the hot water inlet chamber 5 and the temperature sensing chamber 6.

Over time the water temperature in the temperature sensing chamber 6 with fall below the predetermined, level and the temperature actuated valve assembly 15 will revert to its default position. This completes the cycle of use of the first embodiment of the present invention.

Figure 4:
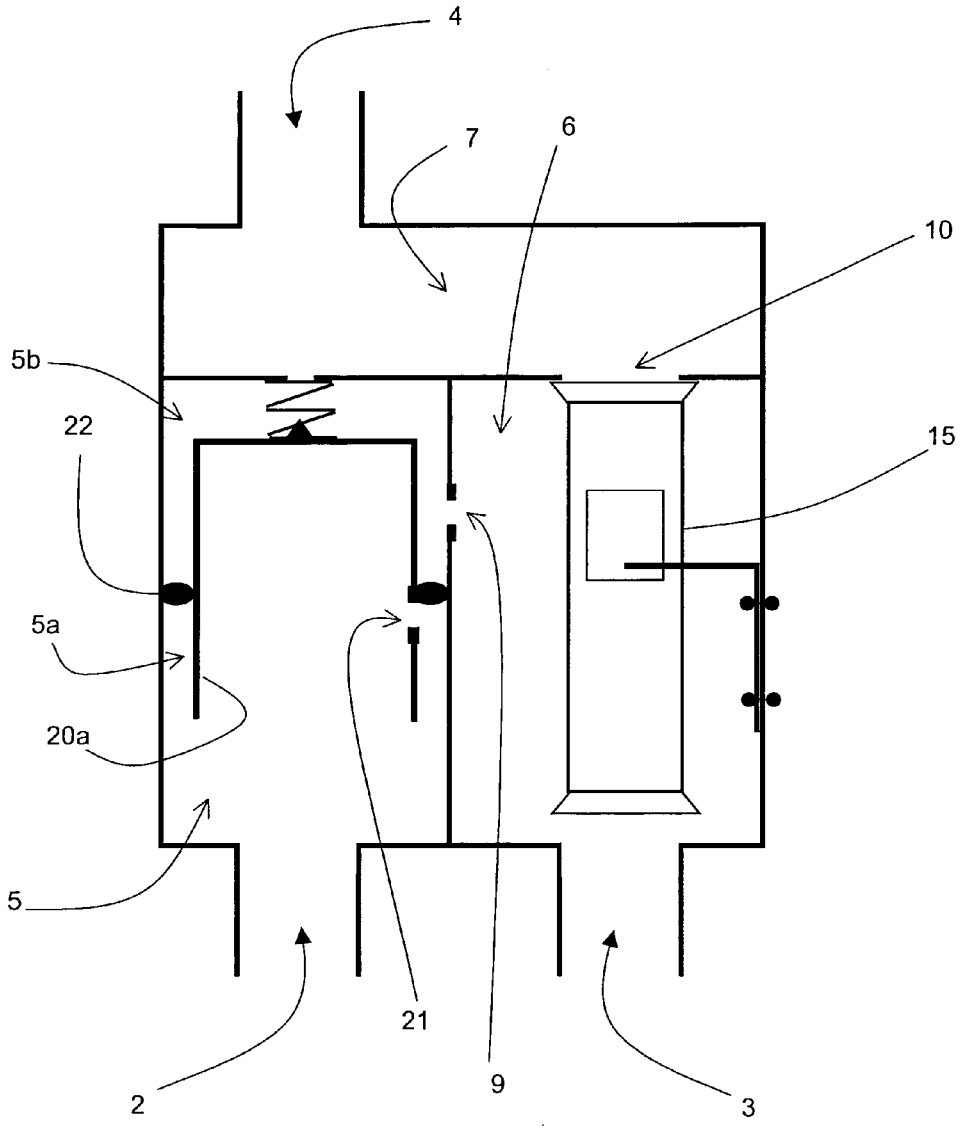
FIG. 4 shows a second embodiment of the present invention wherein the water saving device is connected to a closed water discharging means.
Figure 5:
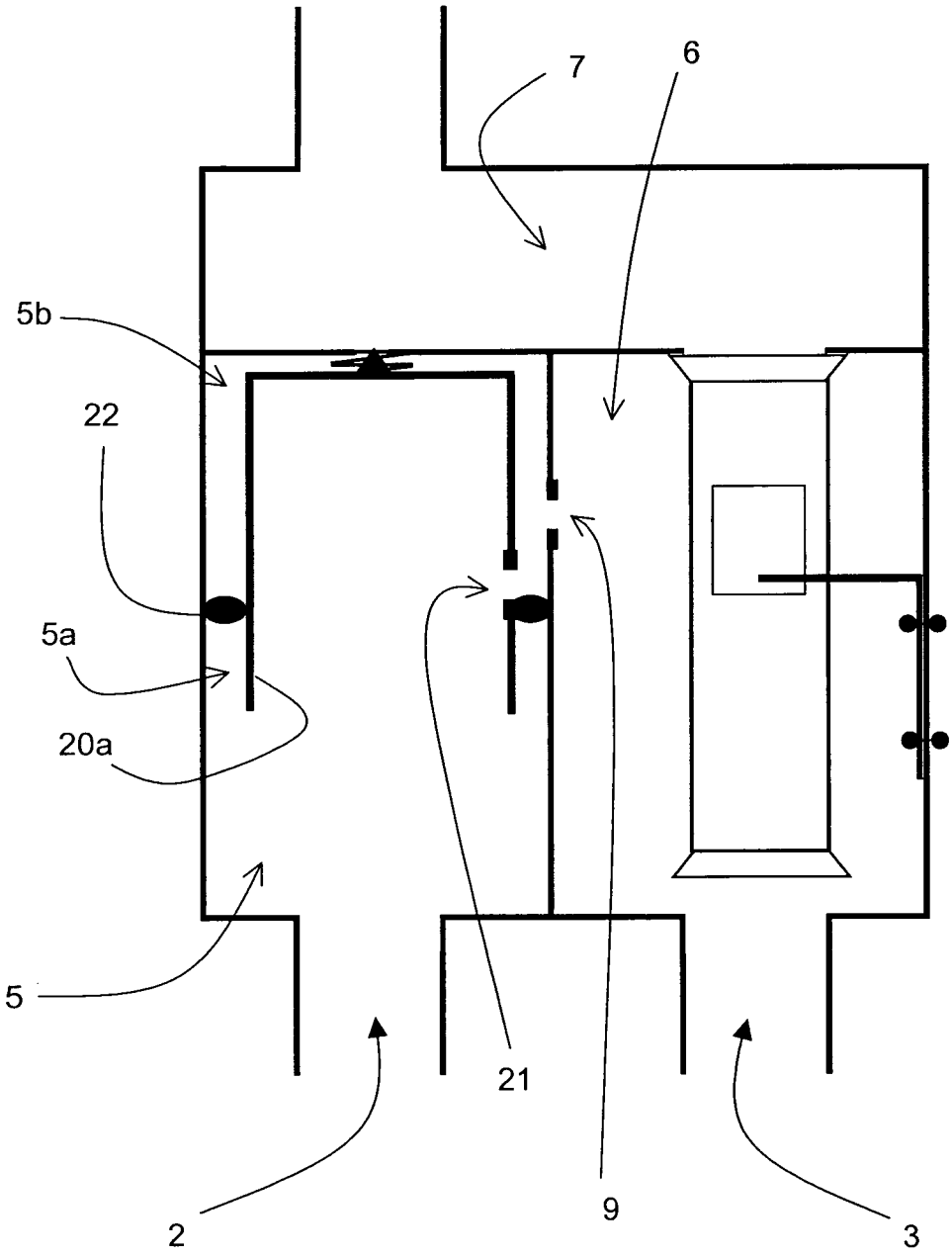
FIG. 5 shows a second embodiment of the present invention wherein the water saving device is connected to an open water discharging means but the water entering the device is below a predetermined level.
Figure 6:
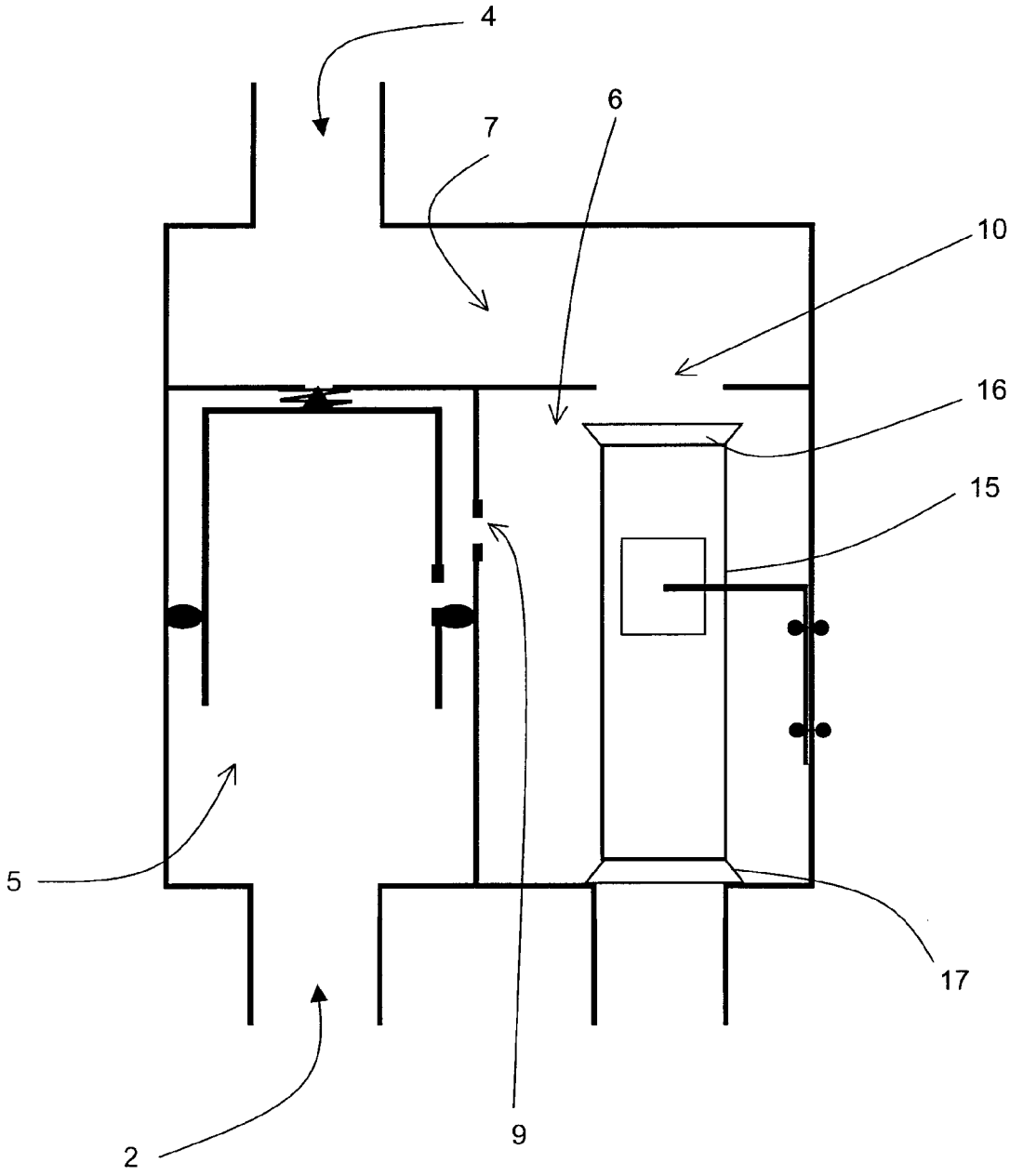
FIG. 6 shows a second embodiment of the present invention wherein the water saving device is connected to an open water discharging means and the water entering the device is above a predetermined level.

The cycle of use of a second embodiment of the present invention is shown in FIGS. 4-6. The water saving device shown in FIGS. 4-6 is generally the same as the first embodiment and thus can be appreciated without much further description. However, the piston arrangement of the second embodiment does differ from that of the first embodiment and will benefit from further description.

The only structural differences between the water saving device of the first and second embodiments can be found in the piston arrangement in the hot water inlet chamber 5. As in the first embodiment, the piston 20*a* helps to define two sub-chambers 5*a*, 5*b* with the hot water inlet chamber 5. However, the rest of the piston arrangement differs.

The piston 20*a* is slideably mounted within the chamber 5, but the piston does not slide in direct contact with the walls of the chamber 5. Instead the chamber further comprises a seal 22, preferably an "O" ring or some such similar fitting. The seal 22 is located between the chamber side walls and the piston 20*a* so as to define the two sub-chambers 5*a*, 5*b*. The second sub-chamber 5*b* of the hot water inlet chamber 5 is in fluid communication with both the hot water outlet chamber 7 and the temperature sensing chamber 6 via the first and second ports 8 and 9 respectively.

The piston 20*a* having an outlet 21 through which water can flow.

When the piston 20*a* is in the first position, i.e. the water pressure in the first and second sub-chambers 5*a*, 5*b* of the hot water inlet chamber 5 are equalised, the piston outlet discharges into the first sub-chamber 5*a*. In this position the water can flow through the piston but remains within the first sub-chamber 5*a*.

When the hot water discharging means is opened the drop in water pressure in the second sub-chamber 5*b* results in the movement of the piston 20*a* under the force of the water pressure in the first sub-chamber 5*a*. FIGS. 5 and 6 show the piston 20*a* in its second position, wherein the piston outlet 21 discharges into the second sub-chamber 5*b* of the hot water inlet chamber 5.

Once the piston 20*a* is in the second position and the water can flow into the temperature sensing chamber 6 via the second port 9 the remaining cycle of use follows that of the first embodiment described above.

It will be appreciated that the components of the water saving device should be made from non-corrosive materials. Suitable plastics materials such as Acetal resin, PVC and Nylon, and non-rusting metals stainless steel and brass are preferable.

Figure 7:
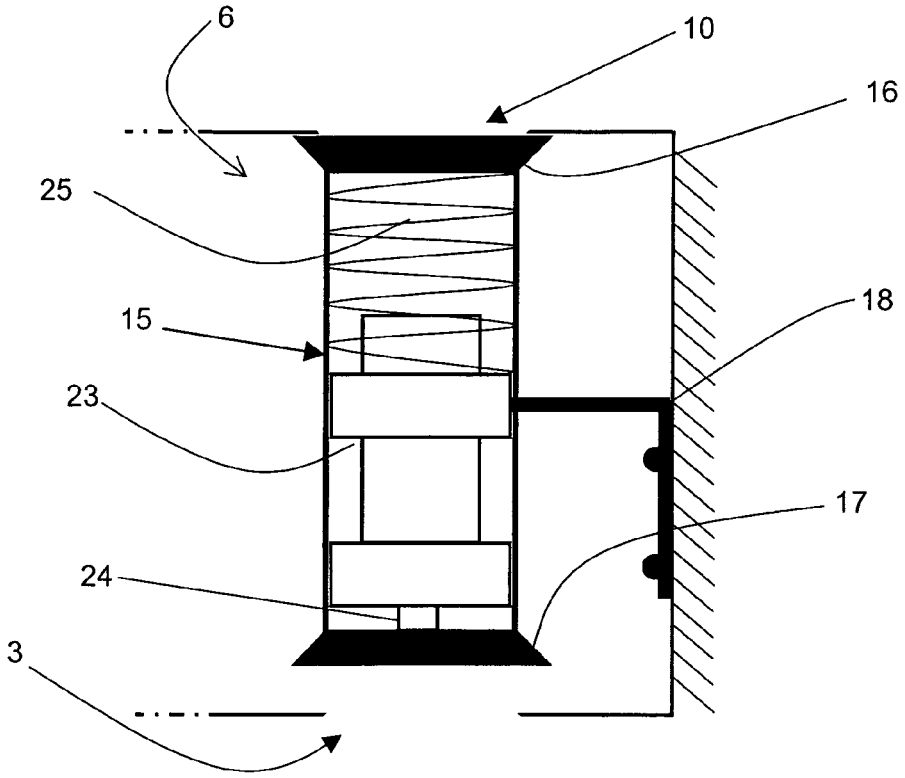
FIGS. 7 and 8 show a preferred embodiment of the temperature sensitive valve assembly in its first and second positions.
Figure 8:
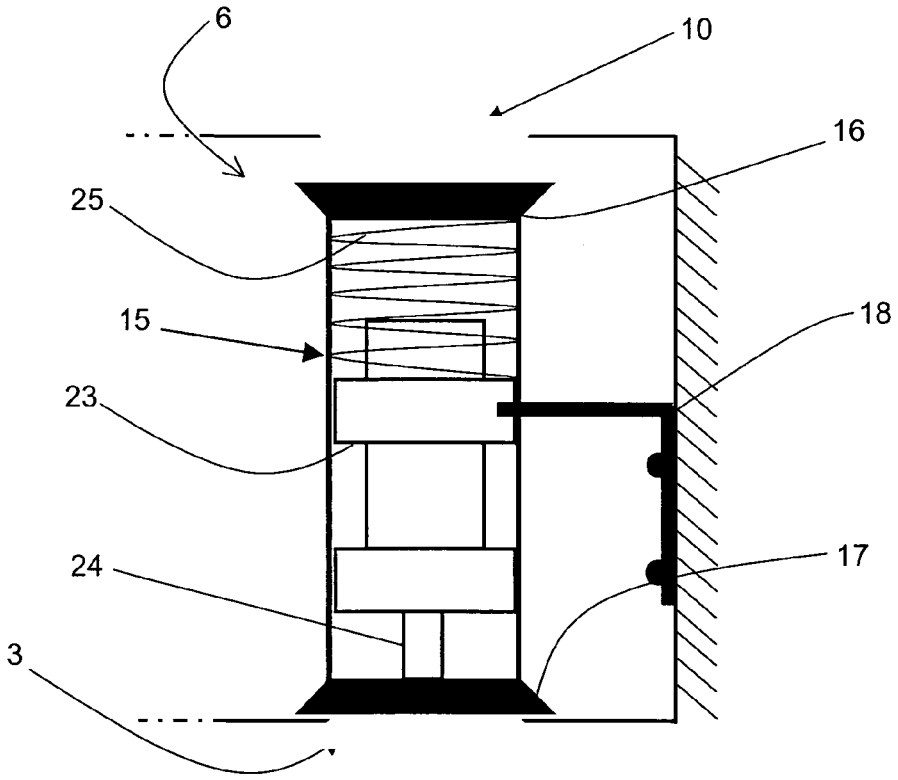

A preferred embodiment of the temperature sensitive valve assembly 15, briefly described above, is shown in FIGS. 7 and 8. The valve assembly 15 comprises a tube with the first and second valves means 17, 16 located on opposite ends of the tube. A temperature sensitive actuator 23 is slideably housed within the tube.

The temperature sensitive actuator 23 is directed towards one end of the tube by a resilient biasing means 25, which is preferably a coil spring made from a suitably non-corrosive material. Preferably the biasing means has a strength of about 6 Nm. The actuator 23 is directed towards the end of the tube on which the first valve means 17 is located.

The temperature sensitive actuator 23 contains thermal wax which expands as it is heated. As the thermal wax expands it pushes an actuator pin 24 out of the temperature sensitive actuator 23.

As mentioned above the temperature sensitive valve assembly 15 is attached to the wall of the temperature sensing chamber 6 by way of a support structure 18. The support structure 18 is attached to the valve assembly 15 by way of the temperature sensitive actuator 23. In this way the tubing, and the valve means, are free to move within a fixed plane relative to the chamber 6.

The force with which the actuator pin 24 is pushed out of the actuator 23 by the thermal wax is such that the tube, and the valve means, are caused to move from a first position (shown in FIG. 7), where the cold water outlet 3 is open and valve means 16 blocks the third port 10, to a second position (shown in FIG. 8), where the third port 10 is open and valve means 17 blocks the cold water outlet 3.

The resilient biasing means 25 ensure that, when the thermal wax is not in its expanded state, the valve assembly 15 reverts to the first position.

The invention claimed is:

1. A water saving device for a hot water discharging means, said device comprising:

a housing having a hot water inlet chamber having a hot water inlet connectable to a hot water supply, a temperature sensing chamber having a cold water outlet connectable to a water storage system, and a hot water outlet chamber having a hot water outlet connectable to said hot water discharging means;

said hot water inlet chamber and said hot water outlet chamber being interconnected by a first port, said hot water inlet chamber and said temperature sensing chamber being interconnected by a second port, and said temperature sensing chamber and said hot water outlet chamber being interconnected by a third port;

a water-pressure actuated piston being slideably mounted within the hot water inlet chamber to define two separate sub-chambers, the first sub-chamber being in fluid communication with the hot water inlet and the second sub-chamber being in fluid communication with the hot water outlet chamber via said first port, said piston being displaceable upon a predetermined drop in water pressure in the hot water outlet chamber, caused when the hot water discharging means is opened, from a first position, in which the second port is closed by the piston, to a second position, in which the second port is open; and said temperature sensing chamber having a temperature-sensitive valve assembly that closes the third port when the temperature of water flowing through the housing is below a predetermined level and being arranged to open the third port and close the cold water outlet when the temperature of water flowing through the chamber is above a predetermined temperature.

2. The water saving device of claim 1, wherein the water-pressure actuated piston comprises an outlet which, when the piston is in the second position, aligns with the second port to enable the hot water inlet chamber to communicate with the temperature sensing chamber.

3. The water saving device of claim 2, wherein the first and second sub-chambers of the hot water inlet chamber are defined by the interaction of the water-pressure actuated piston and a water tight seal located between the piston and the walls of the hot water inlet chamber, said seal being arranged such that the second sub-chamber is in fluid communication with the second port.

4. The water saving device of claim 3, wherein the piston outlet is located within the first sub-chamber when the piston is in the first position and in the second sub-chamber when the piston is in the second position.

5. The water saving device of claim 3, wherein the first port comprises a one-way valve that only allows water to flow from the second sub-chamber of the hot water inlet chamber to the hot water outlet chamber.

6. The water saving device of claim 2, wherein the water-pressure actuated piston is biased towards the first position by a resilient biasing means.

7. The water saving device of claim 2, wherein the first and second sub-chambers of the hot water inlet chamber are defined by the water- pressure actuated piston, which fits within the hot water inlet chamber.

8. The water saving device of claim 1, wherein the water-pressure actuated piston is biased towards the first position by a resilient biasing means.

9. The water saving device of claim 8, wherein the first and second sub-chambers of the hot water inlet chamber are defined by the water- pressure actuated piston, which fits within the hot water inlet chamber.

10. The water saving device of claim 8, wherein the first and second sub-chambers of the hot water inlet chamber are defined by the interaction of the water-pressure actuated piston and a water tight seal located between the piston and the walls of the hot water inlet chamber, said seal being arranged such that the second sub-chamber is in fluid communication with the second port.

11. The water saving device of claim 1, wherein the first and second sub-chambers of the hot water inlet chamber are defined by the water-pressure actuated piston which fits within the hot water inlet chamber.

12. The water saving device of claim 11, wherein said second port comprises a first ceramic washer and the piston outlet comprises a second ceramic washer, said washers being arranged to facilitate a water-tight seal when the piston is in the first position whilst allowing fluid communication between the hot water inlet chamber and the temperature sensing chamber when the water-pressure actuated piston is in the second position.

13. The water saving device of claim 1, wherein the piston further comprises a plug member that blocks the first port when the piston is in the second position.

* * * * *